United States Patent [19]

Moore et al.

[11] 4,080,694

[45] Mar. 28, 1978

[54] METHOD FOR SEPARATING AND WINDING PRE-TREATED TIRE CORD

[75] Inventors: Thomas W. Moore, Columbia, S.C.; Richard A. Hager, College Park, Ga.; Robert J. Clarkson, Winnsboro, S.C.

[73] Assignee: Uniroyal, Inc., New York, N.Y.

[21] Appl. No.: 489,229

[22] Filed: Jul. 17, 1974

[51] Int. Cl.[2] ..... D02H 9/00

[52] U.S. Cl. ..... 28/170; 28/171; 28/218; 225/97; 225/99; 427/176; 427/289

[58] Field of Search ..... 225/3, 4, 5, 98, 99, 225/97; 83/302, 332, 407, 408, 425, 7, 32, 105; 28/40, 72 CS, 72.5, 72.6, 74 R, 74 H, 74 P, 170, 171, 218; 242/56.2, 56.3, 56.4, 56.5, 56.6, 56.7; 425/367; 427/176, 289

[56] References Cited

U.S. PATENT DOCUMENTS

| | | | |
|---|---|---|---|
| 1,164,422 | 12/1915 | Spiegel | 83/105 |
| 2,214,593 | 9/1940 | Mustin et al. | 83/425 X |
| 3,103,843 | 9/1963 | Schoenberger, Jr. | 83/425 X |
| 3,357,172 | 12/1967 | Evans | 28/72 CS |
| 3,398,220 | 8/1968 | Port et al. | 28/72 CS |
| 3,606,114 | 9/1971 | Kim | 225/3 X |
| 3,777,998 | 12/1973 | Jores et al. | 242/56.2 |
| 3,789,469 | 2/1974 | Kodama | 28/40 X |

*Primary Examiner*—J. M. Meister
*Attorney, Agent, or Firm*—Holler, Norbert P.

[57] ABSTRACT

A method and apparatus for separating and winding pre-treated yarn, for example, tire cord, the method comprising two stages. In a first stage, a coated and heat-set fabric, constituted of longitudinally running warp cords and laterally running picks interlaced with the warp cords, is subdivided into a plurality of elongate tapes, each tape having a lesser number of warp cords than the fabric and picks of reduced linear extent. The tapes are then wound into respective packages. In the second stage, the tapes are unwound and divided each into a plurality of independent warp cords free from the picks. The warp cords are then wound into respective packages.

9 Claims, 5 Drawing Figures

METHOD FOR SEPARATING AND WINDING PRE-TREATED TIRE CORD

BACKGROUND OF THE INVENTION

The present invention relates generally to a method of, and apparatus for, separating and winding pre-treated yarn, and more particularly to a method of, and apparatus for, dividing pre-treated tire cord fabric into a plurality of tapes, each tape having a plurality of warp cords and picks interlaced with the warp cords, and thereafter dividing each tape into independent warp cords which are free from the picks.

Tire cord such as that constituted of nylon, polyester, rayon, Aromatic polyamide, etc., is generally treated prior to being wound into packages for storage and shipping. Treatment of the tire cord involves subjecting it to an RFL (Resorcinol Formaldehyde Latex) dip, and heat-setting it under a desired tension to impart thereto selected characteristics and properties most suitable for use in pneumatic tires, namely in the carcass and/or breaker thereof.

Conventional treatment involves the advancement of one or a plurality of independent cords in parallel relation into an RFL bath and through an oven. The yarn ends or cords are associated with respective guides, pulleys and spools in the course of their advancement through the RFL bath and oven. The rate of advancement of the yarn ends or cords is usually no greater than 50 yards per minute in order to insure that they are stretched, RFL coated and heated for a period necessary to impart thereto desired characteristics and properties.

Since each yarn end or cord requires independent handling by independent guides, pulleys and spools, each being duplicated a number of times corresponding to the number of yarn ends or cords, the apparatus is inherently complex, expensive and inefficient. Moreover, since the individual ends or cords must be advanced through the RFL bath and oven prior to being wound into respective packages, the rate of advancement of the ends or cords is inherently a function of the coating, heating and drying time of the cords. Only by lengthening the oven can the rate of advancement of the ends of cords be increased. However, the length of the oven cannot be excessive without being too expensive and requiring too much space. Accordingly, from the standpoint of apparatus complexity, apparatus expense, apparatus efficiency and product production time, etc., conventional treating and winding apparatus and practices are undesirable.

SUMMARY OF THE INVENTION

Accordingly, it is an object of the present invention to provide a novel method of, and apparatus for, separating and winding yarn ends or cords which while joined in the form of a fabric have been earlier RFL or otherwise chemically treated and heat-set under necessary conditions so as to be imparted with desirable characteristics and properties for use in for example, pneumatic tires, belting and other industrial products. Thus, it is an object to separate the yarn treating operation from the yarn winding operation.

It is another object of the present invention to gather yarn ends or cords in respective packages in different stages whereby in one stage a fabric is divided into tapes having a plurality of joined cords each, and in a second stage the tapes are divided into separate cords.

It is still another object of the present invention to provide apparatus for winding groups of yarn ends joined in the form of respective tapes into respective helically wound packages, wherein each package developed by the apparatus displays a substantially non-varying diameter throughout its axial extent.

With the above objects in mind, the present invention is related to a method of, and apparatus for, gathering tire cord or yarn in two separate stages after an initial RFL treating a heat-setting operation. The two stage method involves in one stage subdividing tire cord fabric (the fabric having already been treated in an RFL bath and heat-set), constituted of longitudinally running warp cords and laterally running picks interlaced with the warp cords, into a plurality of elongate tapes each having a lesser number of warp cords than the fabric and picks of reduced linear extent. Each tape is then wound into a respective package. In a second stage of the method, each tape is unwound and divided into a plurality of independent warp cords free from the picks. The warp cords are then wound into respective yarn or cord packages.

BRIEF DESCRIPTION OF THE DRAWINGS

The above and additional advantages of this invention will be more clearly understood from the following detailed description when read in conjunction with the accompanying drawings, in which.

DETAILED DESCRIPTION OF THE INVENTION

Figures 1, 5:
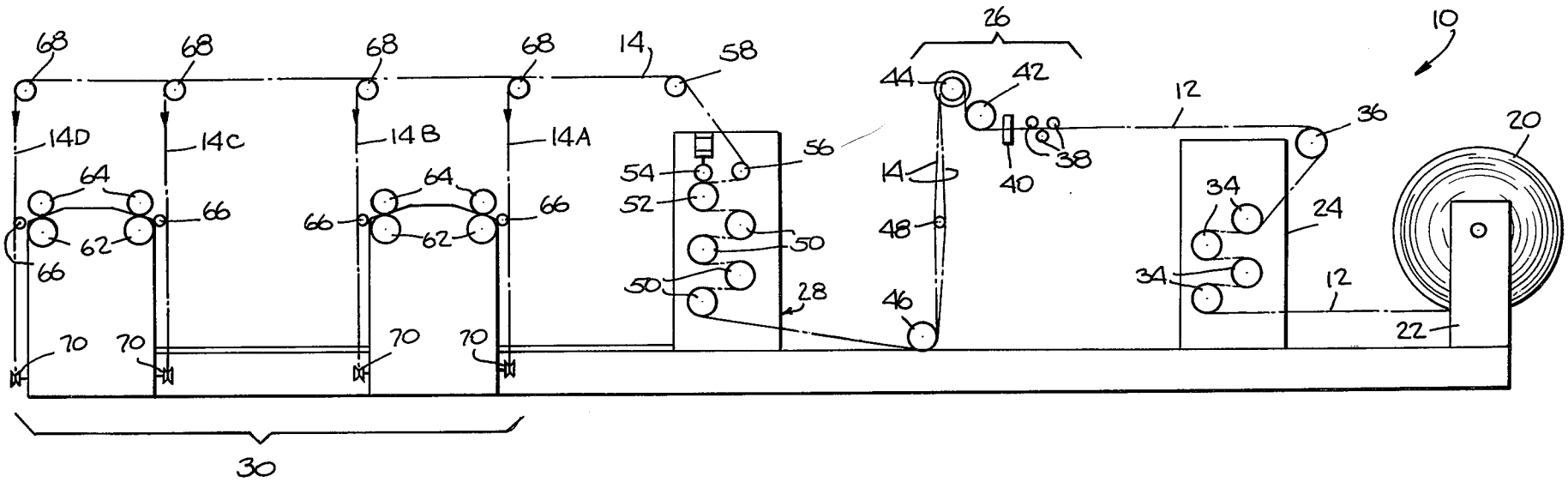
FIG. 1 is a schematic elevational view of a fabric deweaving and winding apparatus pursuant to the present invention.
FIG. 5 is a fragmentary schematic plan view of a typical tape encircled in dashed line in FIG. 2 and denoted by reference character 5.

Referring now to the drawings, and more particularly to FIG. 1, there is illustrated apparatus denoted generally by the reference character 10 for deweaving or separating a fabric 12 into a plurality of fabric portions or tapes 14. The fabric 12 is constituted such that it has been previously RFL treated and heat-set such that the individual yarn ends or warp cords 16 thereof, with which are interlaced laterally extending picks 18, display desirable characteristics and properties useful in building pneumatic tire carcasses and breakers. The warp cords 16 may be constituted of nylon, polyester, rayon, Aromatic polyamide, etc. and preferably number between 400 and 1700 end in the fabric 12. More specifically, the warp cords 16 range from 6 to 30 ends per inch, and the picks range from 2 to 6 per inch.

The method of, and apparatus for, RFL treating and heat-setting the fabric 12 may be conventional such as, for example, the means disclosed in U.S. Pat. No. 2,995,178, issued on Aug. 8, 1961 to A. J. Saulino et al., the subject matter of which is incorporated herein by reference. As taught in the abovementioned patent, fabric is unwound from a roll and is advanced in succession through an oven and through RFL treating apparatus, whereby the warp cords of the fabric are imparted with appropriate characteristics and properties necessary for use in pneumatic tires. After treatment of the fabric, the latter is wound into a package. Each fabric package so formed is then subsequently operated upon by the means and method of the present invention.

In this respect, a fabric package 20 is freely journaled upon a let-off stand 22, and is pre-threaded in a manner illustrated in FIG. 1 through a tension-inducing station 24, a fabric deweaving station 26, a fabric-pulling station 28 and a tape-winding station 30. The let-off stand 22 is conventional in nature and is provided with a spindle 32 upon which the fabric package 20 may be supported. The tension-inducing station 24 is provided with conventional friction or hold-back rollers 34 across and at least partially around which the fabric 12 is pre-threaded to an upper idler guide roller 36. The fabric deweaving station 26 includes conventionally mounted guide rollers 38, a photoelectric fabric edge sensor 40, a larger guide roller or bar 42, a grooved fabric-separating roll 44, a lower guide roller or bar 46, and a lease bar 48 interposed between and extending parallel to the grooved fabric-separating roll 44 and the lower bar 46. The fabric-pulling station 28 includes four pulling rollers 50, a pressing roller 54, an upper pulling roller 52, an idler roller 56 adjacent to the pulling roller 52, and an upper idler guide roller 58.

Figure 2:
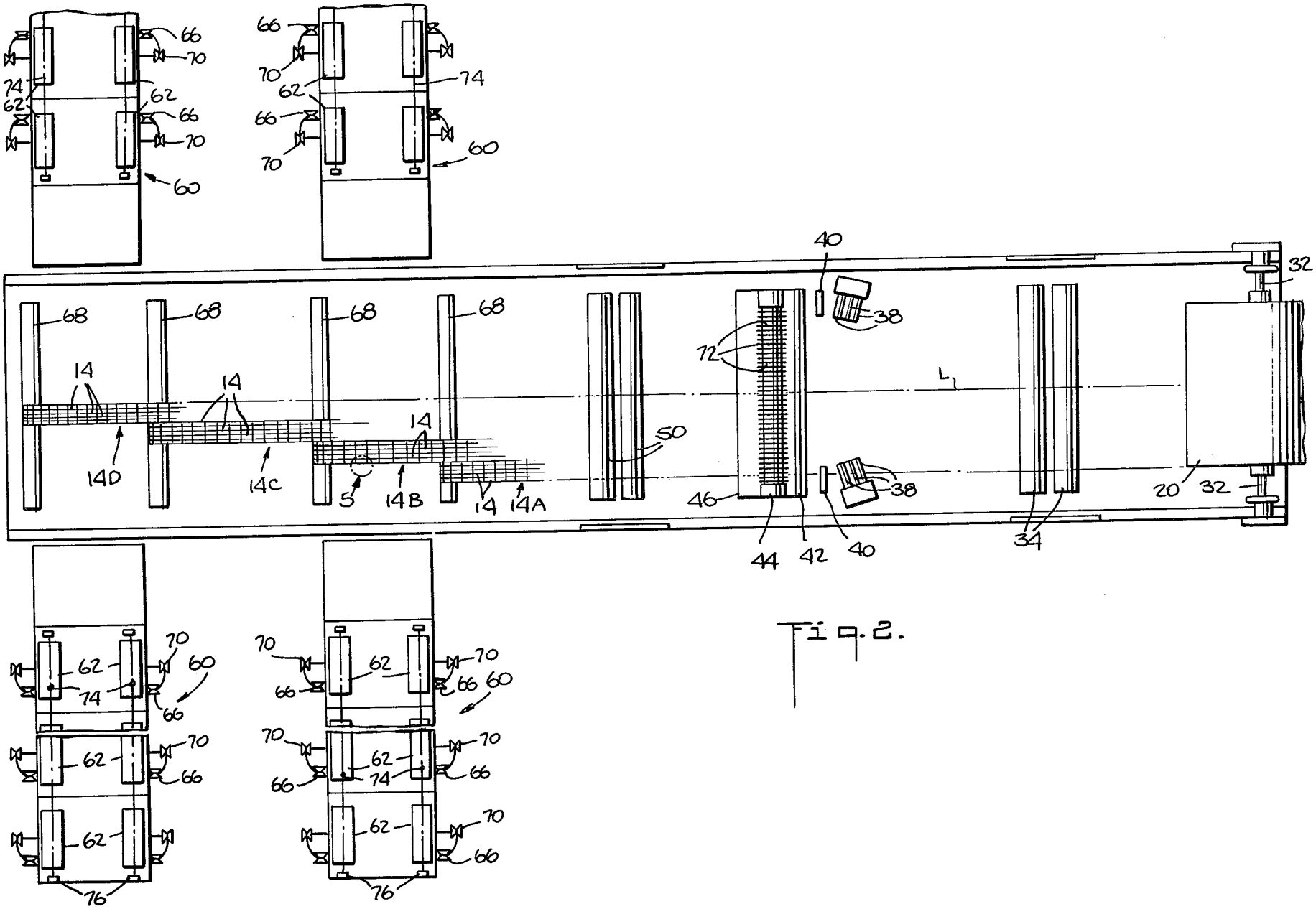
FIG. 2 is a schematic plan view of the apparatus illustrated in FIG. 1.

The fabric winding station 30 includes four banks 60 of winders, one pair of banks 60 being disposed to one side of the advancing fabric 12 and the other pair of banks 60 to the other side of the advancing fabric 12 (FIG. 2). Each of the banks 60 includes ten (only six are shown) package winders 62, five such winders 62 on each side of each bank 60. Associated with each winder 62 is a respective pressing roller 64 and a respective traverse guide pulley 66, the operation of the latter being described below. Spaced above and parallel to the two pairs of banks 60 are four overhead guide bars 68. Each of the banks 60 furthermore includes ten lowermost guide rollers 70 (five such rollers 70 on each side of each bank 60) for association with respective ones of the winders 62. Each of the rollers 70 is at a slightly different elevation than the others along each side of each bank 60 so that respective ones of the tapes 14 may be pre-threaded without interference to their associated ones of the rollers 70.

Pre-theading of the fabric 12 is effected as follows:

Once a fabric package 20 is properly mounted upon the let-off stand 22, the fabric 12 is unwound and pre-threaded across and partially around the rollers 34 of the tension-inducing station 24. Thereafter, the fabric 12 is pre-threaded across and partially around the upper roller 36 and to the fabric deweaving station 26. The fabric 12 at the station 26 is pre-threaded across the rollers 38 and the photo-electric edge sensing device 40, and from there across and at least partially around the roller 42 and upwardly to the grooved roll 44.

The grooved roll 44, which is provided with adjacently spaced grooves separated from one another by respective flanges 72 (FIG. 2), accommodates portions of the fabric 12 in respective ones of its grooves. Each groove has an axial spacing sufficient to accommodate a plurality of warp cord 16, for example forty such warp cords 16 per groove. It will be understood, therefore, that each tape 14 will, as described below, comprise in this instance forty such warp cords 16.

The fabric 12 is then pre-threaded across and at least partially around the lower roller 46 and to the fabric-pulling station 28. Between the grooved roll 44 and the lower roller 46, during the pre-threading operation, the lease bar 48 is inserted into the fabric 12 such that alternate groups of forty warp cords 16 pass across each side of the lease bar 48. The opposite ends of the lease bar 48 may then be affixed to an appropriate support (not shown).

The fabric 12 is then pre-threaded through the fabric-pulling station 28 and upwardly therefrom to a first or upstream-most one of the overhead bars 68. At the first overhead bar 68, a set 14A of five groups of forty warp cords each are removed or separated from the remainder of the fabric 12 on one side of the center-line thereof, such as by manually severing the picks 18 interlaced with the warp cords 16 between each group of the forty warp cords 16 at the first overhead bar 68. Each group of forty warp cords 16 is then pre-threaded downwardly across and partially around a respective one of the lower guide rollers 70 on the up-stream side of the first bank 60, and upwardly therefrom to and partially around a respective traverse guide pulley 66 and thence to a respective one of the winders 62. This procedure is repeated for second, third and fourth sets 14B, 14C and 14D, respectively, of five groups of forty warp cords each on each side of the fabric centerline, each set being divided into separate groups of forty warp cords each which are pre-threaded to respective ones of the winders 62 remaining.

The pre-division of the fabric 12 into the four separate sets of five groups of forty warp cords is illustrated generally in FIG. 2 for only one half of the fabric 12. A similar pre-division of the fabric 12 into respective sets of five groups of forty warp cords each is effected for the other half of the fabric 12 (not shown). Thus, each overhead bar 68 on opposite sides of the center line of the fabric 12 in FIG. 2 guides two sets of five groups of forty warp cords each downwardly to one side of a respective one of the banks 60. Each overhead bar 68, therefore, accommodates symmetrically ten groups of forty warp cords each.

After the pre-threading operation, the winders 62, which may, for example, be mounted in groups of five on a common spindle 74, may be rotated via a conventional drive means, such as a motor 76 or the like, so that each group of forty warp cords each can be wound upon a respective one of the winders 62. Each traverse guide pulley 66 associated with a respective one of the winders 62 functions to helically guide a respective one of the groups of forty warp cords each on the periphery of its associated one of the winders 62 by being reciprocated, in a manner as will be described below, axially relative to its associated one of the winders 62.

Once the fabric 12 has been pre-threaded throughout the apparatus 10, as described above, it is ready to be divided, pursuant to a "first stage" of the method of the present invention, into a plurality of independent adjacent tapes 14. Each tape 14 corresponds to a respective one of the groups of forty warp cords each, and therefore each tape 14 will be formed with forty such warp cords. The tapes 14 are formed and separated from one another by means of the annular flanges 72 of the grooved roll 44. This occurs as the fabric 12 is advanced under tension across the grooved roll 44 during which each group of forty warp cords each is confined laterally in a respective groove and the picks 18 are torn by the flanges 72 between each group, thereby forming respective tapes 14. Thus, it is the grooved roll 44 which acts to deweave or separate the fabric 12 into adjacent tapes 14, each tape 14 still retaining sections of the picks 18 interlaced with the warp cords 16. These pick sections have a length for the most part corresponding to the width of each tape 14.

In order to insure that longer pick sections not torn between adjacent tapes 14 are withdrawn from one or the other of two adjacent tapes 14, alternate ones of tapes 14 are advanced on each side of the lease bar 48. It will be understood that the grooved roll 44 deweaves or separates the fabric 12 into adjacent tapes 14, and the lease bar 48 supplements the function of the grooved roll 44 by dislodging longer sections of the picks 18 which were not earlier torn by the grooved roll 44.

The adjacent tapes 14 are then advanced adjacent one another through the fabric-pulling station 28 and to the overhead bars 68. Because of the pre-threading of each set of five groups of forty warp cords each from a respective one of the overhead bars 68 to respective sides of banks 60, and thence to respective ones of the winders 62, the tapes 14 are divided in sets of five tapes each on each side of the center line of the fabric 12 (FIG. 2) and are advanced to respective ones of the winders 62. Thus, as illustrated in FIG. 2, the set of tapes 14A is constituted of five adjacent but separated tapes 14 and is separated from the remaining sets 14A, 14B and 14C by being withdrawn from the first overhead bar 68, upstream of the other overhead bars 68, such that each one of its five tapes 14 is guided to a respective lower guide roller 70, and upwardly therefrom to a respective traverse guide pulley 66 and on to a respective one of the winders 62.

Similarly, a second set 14B of five tapes 14 is separated from the remaining sets 14C and 14D on each side of the fabric centerline "L" at the second overhead bar 68, and its tapes 14 are guided and wound upon respective ones of the winders 62 on the other or downstream side of the first bank 60. This procedure occurs also for the sets of tapes 14C and 14D on each side of the fabric centerline "L" which are separated from one another and guided to respective winders 62 by the third and fourth overhead bars 68. After each winder 62 has been wound up to an appropriate tape package diameter (each wound tape 14 being constituted of warp cords 16 and sections of the picks 18 still interlaced with the warp cords 16), the tape packages are removed from the apparatus 10 and stored for a subsequent operation which constitutes a "second stage" of the method of the present invention.

Figure 3:
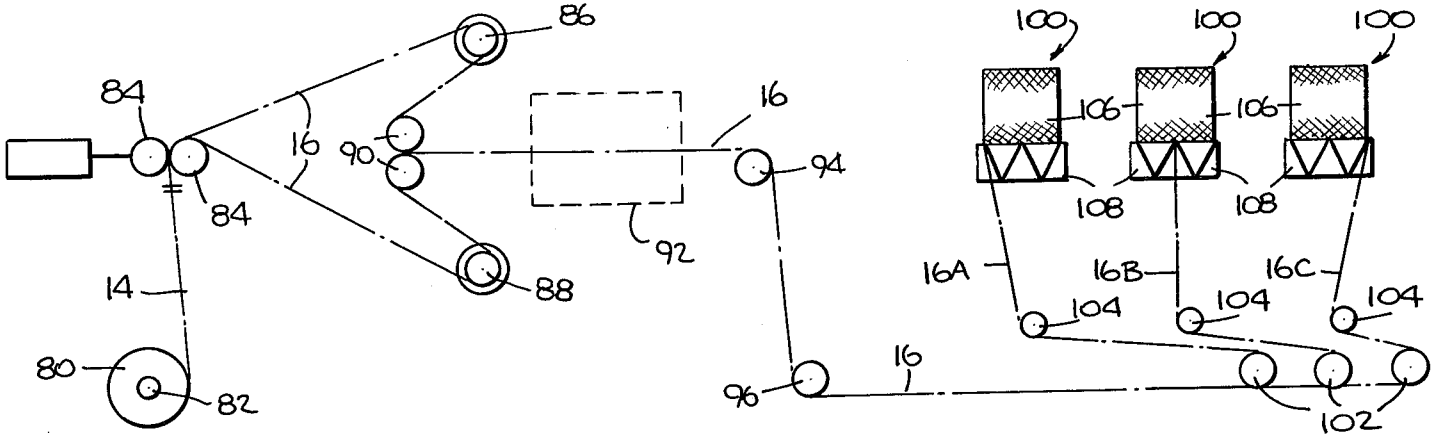
FIG. 3 is a schematic elevational view of a tape deweaving and winding apparatus pursuant to the present invention.

The "second stage" is illustrated in FIG. 3 and involves the breakdown or deweaving of the tapes 14 into independent warp cords 16 which are entirely free from those sections of the picks 18 which remained interlaced with the cords 16 of each of the tapes 14. In this respect, a given tape package, for example that denoted by the reference character 80, is freely journaled upon a supporting axle 82, and the tape 14 thereof is pre-threaded between a pair of tension-inducing (hold-back) rollers 84, one of which is pressed against the other. Then, alternate ones of the warp cords 16 of the tape 14 are pre-threaded across and partially around an upper horizontal tape-separating roll 86, and remaining alternate ones of the warp codes 16 are pre-threaded across and partially around a lower horizontal tape-separating roll 88.

The tape-separating rolls 86 and 88 are grooved and similar to one another and similar to the fabric-separating grooved roll 44 illustrated in FIG. 2. However, the grooves formed in the separator rolls 86 and 88 are separated from one another by a distance corresponding to preferably one half of the width of the tape 14, or approximately one half of the axial extent of each of the grooves presented in the fabric-separating roll 44 of FIG. 2. Thus, the warp cords 16 diverge from one another in a horizontal plane by an amount corresponding to and governed by the spacing between the grooves in the rolls 86 and 88, and further diverge from one another in a vertical plane because of the manner by which the warp cords 16 are alternately pre-threaded across and partially around the upper and lower rolls 86 and 88.

The two separated groups of warp cords 16 associated with the rolls 86 and 88, respectively, are then pre-threaded toward one another and between a pair of metering rolls 90 pressing against one another, one of which is driven by conventional means not shown. The warp cords 16 are then pre-threaded through a pick removal system 92 having brushes or other agitating means such as blowing air for dislodging any sections of the picks 18 clinging to individual ones of the warp cords 16. The warp cords 16 are then pre-threaded across and at least partially around further rollers such as 94 and 96, and thence to respective winding stations 100 corresponding in number to the number of warp cords 16 in each tape 14 (in this instance forty such stations 100, although only three are shown). Each winding station 100 includes a pair of guide rollers 102 and 104 across and at least partially around which individual warp cords (such as warp cords 16A, 16B and 16C) are pre-threaded to a modified Chavis winder in which a winder 106 having a horizontal axis of rotation operates in conjunction with a helically grooved guide member 108 having a horizontal axis of rotation to effect random winding of the cords into packages.

Once pre-threading of the cords 16 of a tape 14 enwound upon a package 80 is effected as described above, the metering rolls 90 may be actuated to advance the alternately pre-threaded cords 16 to and around the upper and lower tape-separating rolls 86 and 88. Upon advancement of the cords 16, the sections of the picks 18 still interlaced with the warp cords 16 fall free of the advancing warp cords 16 in two mutually perpendicular planes of cord divergency, namely the horizontal plane of the spaced grooves of each of the rolls 86 and 88, and the vertical plane in which the rolls 86 and 88 are separated from one another and in which the cords 16 are alternately threaded from the metering rolls 90 to the separating rolls 86 and 88.

In order to insure that any sections of the picks 18 which thereafter still cling to individual ones of the warp cords 16 are dislodged from the latter, the cords 16 are advanced through the pick removal system 92 so that its brushes or other suitable means, such as blowing air, dislodge the remaining clinging sections of the picks 18. Thereafter, the individual warp cords 16 which are now free from the picks 18 are advanced to and open respective ones of the winders 106 to form respective cord packages.

Accordingly, the concept of the present invention relates to a "two stage" method of gathering and winding cord into cord packages, the cord being obtained from a warp-cord and pick fabric which has been previously RFL treated and heat-set to present characteristics and properties necessary for use in pneumatic tires. The two stage procedure incorporates, in a "first stage", the separation of the fabric 12 into separate tapes 14, each tape 14 having torn pick sections interlaced with the warp cords and wound into a respective tape package. The tapes, in a "second stage", are then separated into individual warp cords free from the torn pick sections and wound into respective cord packages. The deweaving of the fabric into separate tapes and the deweaving of the tapes into separate cords is done rapidly (300 yards/minute) without and apart from equipment for RFL treating and heat-setting the fabric, and involves simply fabric and tape separation and tape and cord winding.

Figure 4:
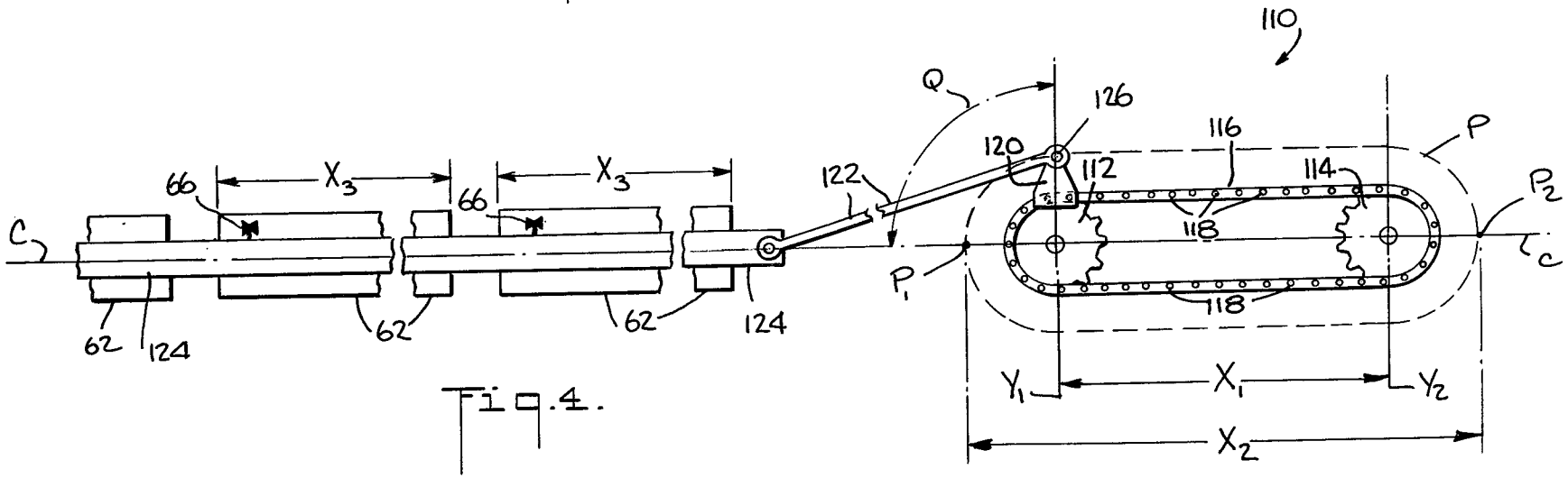
FIG. 4 is a schematic elevational view of apparatus pursuant to the present invention for winding a plurality of tapes of yarn in unison.

Referring now to FIG. 4, there is illustrated a preferred embodiment for effecting helical winding of a group of tapes 14 onto respective winders 62 in unison. Such apparatus is denoted generally by the reference character 110, and each of the banks 60 is provided with two such apparatus 110, one on each side of each of the banks 60. Each apparatus 110 is associated with five winders 62 and a corresponding five traverse guide pulleys 66.

Each apparatus 110 includes a pair of identical sprockets 112 and 114 which are surrounded and interconnected by an endless band 116 in the form of a chain having spaced pins 18 interconnecting chain links. Affixed to two of the pins 118 is a crank plate 120 terminating in a driving end to which is pivotedly connected one end of a rod 122. The opposite end of the rod 122 is pivotedly connected to an endwise shiftable bar 124 which is slidably supported by means not illustrated in the drawing in a conventional manner along the horizontal center line C of the sprockets 112 and 114 and adjacent to one side of a bank 60 associated therewith.

The bar 124 has an elongate extent corresponding to the elongate extent of the side of the bank 60 associated therewith and, thus, the bar 124 bridges five winders 62. The bar 124 can be reciprocated axially of the winders 62 as the endless chain 116 is driven by one of the sprockets 112, 114 during which the crank plate 120 displaces the rod 122 interconnecting the crank 120 and the bar 124.

Affixed to the bar 124 are five of the traverse guide pulleys 66 (only two are shown), each of which is shiftable relative to its corresponding winder 62 over the axial extent of the latter during reciprocation of the bar 124. Thus, the bar 124 is reciprocated over a distance corresponding to the axial extent of each of the winders 62 to effect simultaneous reciprocation of each of the traverse guide pulleys 66 relative to their respective winders 62.

In order to effect reciprocation of the bar 124 over the distance corresponding to one of the winders 62, the following relationship exists:

$$R = X_1 + 2(r + r'),$$

wherein

- $R$ = the distance of reciprocation of the bar 124 in one direction;
- $X_1$ = the distance between the vertical center line $Y_1$ of the sprocket 120 and the vertical center line $Y_2$ of the sprocket 114;
- $r$ = the radius of the sprocket 112 or the sprocket 114; and
- $r'$ = the effective length of the crank plate 120 along the vertical center line $Y_1$ of the sprocket 112.

Accordingly, the span of reciprocation R of the bar 124 in one direction is identical to the span $X_2$ denoted in FIG. 4 which corresponds to the distance along the horizontal centerline C common to the bar 124 and the sprockets 112 and 114. This distance is defined by two points $P_1$ and $P_2$ along the centerline C on the locus P traversed by a pin connector or crank pin 126 interconnecting one end of the rod 122 and the end of the crank plate 120. Accordingly, the axial extent $X_3$ of each winder 62 is selected to correspond to the aforementioned horizontal span $X_2$, namely the span of reciprocation R of the bar 124 in one or the other of its directions.

Accordingly, in operation, as the chain 116 is driven by one of the sprockets 112, 114, and the winders 62 are rotated in unison by their common drive 76 (FIG. 2), the crank plate 120 is moved along together with the chain 116 relative to the revolving winders 62. When the crank plate 120 is moving between the vertical center lines $Y_1$ and $Y_2$ of the sprockets 112 and 114, respectively, it moves at a uniform velocity, as does the bar 124, corresponding to the uniform velocity of the chain runs between the center lines $Y_1$ and $Y_2$. However, as the crank plate 120 passes from the position illustrated in FIG. 4, and moves in a counterclockwise direction into the quadrant Q (the position of the crank plate 120 in FIG. 4 constituting top dead-center of the sprocket 112), the linear velocity of the crank plate 120 is converted into an angular velocity.

The angular velocity of the crank pin 126 is greater than the angular velocity of the chain links in contact with the teeth of sprocket 112 because the radius of curvature traversed by the pin 126 is greater than that of the chain links. As a result, the instantaneous X-component of velocity of the crank pin 126 is greater than the instantaneous X-component of velocity of the chain links in the aforementioned top dead-center position. Since this greater instantaneous X-component of velocity of the crank pin 126 is transferred to the bar 124 via the rod 122, the bar 124 and the traverse guide pulleys 66 affixed thereto are momentarily accelerated. As a result, at each of the opposite ends of each of the winders 62, the traverse guide pulleys 66 associated therewith, respectively, are accelerated momentarily.

Thus, because of the momentary acceleration of the traverse guide pulleys 66 relative to their respective winders 62, at the ends of the latter, the time in which the traverse guide pulleys 66 undergo a dwell (or slow down to a zero velocity in the X-direction), to enable them to reverse their direction of reciprocation, is reduced thereby preventing an excessive build-up or winding of the tapes 14 at the ends of their respective winders 62. As a result, each helical tape package formed presents a substantially cylindrical appearance wherein the middle portion of each winder 62 has a diameter substantially corresponding to the diameter of each of the ends thereof.

The apparatus pursuant to the embodiment illustrated in FIG. 4 is therefore capable of effecting simultaneous winding of a plurality of tapes on respective winders. Moreover, the helical winding angle of each tape 14 upon a respective one of the winders 62 can be varied by changing the rotary speed of the sprockets 112, 114 and/or the rotary speed of the winders 62. The length of each wound package may likewise be varied simply by varying the center distance between the sprockets 112 and 114. In each instance, the package formed will display a substantially uniform cylindrical periphery.

It will be understood that the foregoing description of a preferred embodiment of the present invention is for purposes of illustration only, and that the various structural and operational features and relationships herein disclosed are susceptible to a number of modifications and changes none of which entails any departure from the spirit and scope of the present invention as defined in the hereto appended claims.

What is claimed is:

1. A method of gathering coated reinforcing cord from a fabric constituted of longitudinally running warp cords numbering in a range of approximately 6 to 30 per inch and laterally running picks numbering in a range of approximately 2 to 6 per inch and interlaced with said warp cords, said method comprising treating said fabric as a unit with a liquid whereby said warp cords and picks are coated with said liquid and dried, and then advancing the treated fabric under tension lengthwise of said warp cords, tearing said picks into substantially equal lengths while advancing said fabric to divide the latter into a plurality of tapes each having a lesser number of warp cords than said fabric and picks of reduced length, winding said tapes into respective tape packages, unwinding each of said tape packages individually while advancing the components warp cords thereof lengthwise under tension, dislodging said picks from each of said tapes while advancing the latter, and winding said warp cords freed from said picks into respective packages.

2. A method as claimed in claim 1, including advancing said fabric at least partially around at least one fabric-separating roll having adjacently spaced grooves through which respective ones of said tapes slide and between at least some of said grooves said picks are broken and torn but remain interlaced with certain of said warp cords of each of said tapes.

3. A method as claimed in claim 2, including advancing each of said tapes at least partially around at least one tape-separating roll having adjacently spaced grooves through which respective ones of said warp cords slide and between which grooves the remaining picks interlaced with certain of said warp cords are dislodged at least in part.

4. A method as claimed in claim 3, wherein the spaces between said grooves of said fabric-separating roll and said tape-separating roll are each defined by an annular flange having a greater diameter than those of said grooves separated thereby.

5. A method as claimed in claim 2, including pre-threading alternate groups of said warp cords across one side of a bar spaced downstream in parallel relation with said fabric-separating roll, and pre-threading the remaining alternate groups of said warp cords across the other side of said bar, each of said groups of said warp cords corresponding to a respective one of said tapes to be separated from said fabric by the upstream fabric-separating roll upon subsequent advancement of said fabric across the latter said roll.

6. A method as claimed in claim 3, including pre-threading a first set of alternate ones of said warp cords of each said tape across and at least partially around said tape-separating roll, and pre-threading a second set of alternate ones of said warp cords of each said tape across and at least partially around a further tape-separating roll similar to and radially spaced from the first said tape-separating roll.

7. A method as claimed in claim 6, wherein said grooves in said tape-separating roll are separated from one another by a distance corresponding to at least one-half of the width of said tapes.

8. A method as claimed in claim 1, including winding said tapes upon respective packages by pre-threading each tape through a respective guide shiftable axially of a corresponding one of said packages, rotating each said package at a constant surface speed while reciprocating its corresponding guide at a uniform velocity over a major distance between the axial opposite end portions of each said package, and while still rotating each said package at said constant speed accelerating its corresponding guide at each of the axial opposite end portions of each said package.

9. A method as claimed in claim 8, including winding said tapes simultaneously on their respective packages by reciprocating and accelerating said guides in unison.

* * * * *